US008922190B2

(12) United States Patent
Wu et al.

(10) Patent No.: US 8,922,190 B2
(45) Date of Patent: Dec. 30, 2014

(54) BAND GAP REFERENCE VOLTAGE GENERATOR

(71) Applicants: Jianzhou Wu, Suzhou (CN); Yang Wang, Suzhou (CN)

(72) Inventors: Jianzhou Wu, Suzhou (CN); Yang Wang, Suzhou (CN)

(73) Assignee: Freescale Semiconductor, Inc., Austin, TX (US)

( * ) Notice: Subject to any disclaimer, the term of this patent is extended or adjusted under 35 U.S.C. 154(b) by 153 days.

(21) Appl. No.: 13/714,415

(22) Filed: Dec. 14, 2012

(65) Prior Publication Data

US 2014/0070777 A1 Mar. 13, 2014

(51) Int. Cl.

| | |
|---|---|
| ***G05F 3/30*** | (2006.01) |
| ***G05F 1/10*** | (2006.01) |
| *G05F 3/26* | (2006.01) |

(52) U.S. Cl.

CPC ..... *G05F 1/10* (2013.01)
USPC ..... 323/314; 323/297; 323/316

(58) Field of Classification Search

USPC ..... 323/297, 298, 311, 312, 313, 314, 315, 323/316, 353, 354

See application file for complete search history.

(56) References Cited

U.S. PATENT DOCUMENTS

| | | | | |
|---|---|---|---|---|
| 4,629,972 | A | 12/1986 | Briner et al. | |
| 5,592,165 | A | 1/1997 | Jackson | |
| 7,084,698 | B2 | 8/2006 | Khan | |
| 7,170,274 | B2 | 1/2007 | Mukherjee | |
| 7,482,797 | B2 | 1/2009 | Cave | |
| 7,812,663 | B2 | 10/2010 | Lee | |
| 2005/0237045 | A1 * | 10/2005 | Lee et al. | 323/313 |
| 2007/0296392 | A1 * | 12/2007 | Chen et al. | 323/313 |
| 2008/0116875 | A1 * | 5/2008 | Ma | 323/313 |
| 2009/0284242 | A1 * | 11/2009 | Motz | 323/313 |
| 2011/0242897 | A1 | 10/2011 | Aritome | |

* cited by examiner

*Primary Examiner* — Gary L Laxton
(74) *Attorney, Agent, or Firm* — Charles Bergere

(57) ABSTRACT

A band gap reference voltage generator has first and second current conduction paths between a first node and a second node. The first current conduction path has first resistive elements in series with a first forward-biased PN junction element. A tap is connected selectively to the first resistive elements through switches that are controllable to select a voltage divider ratio at the tap. The second current conduction path includes a second resistive element in series with a second PN junction element of greater current density than the first PN junction. A voltage error amplifier has inputs connected to the tap and the second PN junction element, and an output for providing a thermally compensated output voltage $V_{REF}$. A feedback path applies the output voltage $V_{REF}$ through a third resistive element to the first node.

10 Claims, 3 Drawing Sheets

- PRIOR ART -

- PRIOR ART -

- PRIOR ART -

BAND GAP REFERENCE VOLTAGE GENERATOR

BACKGROUND OF THE INVENTION

The present invention is directed to integrated circuits and, more particularly, to a band gap reference voltage generator.

Reference voltage generators are used widely in integrated circuits (IC) and other electronic circuits to provide a reference voltage that is stable despite variations in fabrication processing conditions from one batch of products to another, and despite variations in operating temperatures. Various techniques are available for compensating the reference voltage for process variations, such as including trim resistors in the circuit design, which can be set or 'trimmed' when producing the IC.

Thermal compensation is commonly obtained by including a band gap module in the reference voltage generator. A band gap module includes forward-biased semiconductor PN junctions, which may be provided by diodes or by diode-connected bipolar junction transistors (BJT) or metal-oxide semiconductor field-effect transistors (MOSFET), for example. The voltage across a forward-biased semiconductor PN junction for a given current through the junction decreases with increasing temperature, commonly called complementary to absolute temperature (CTAT), varying by approximately −2 mV/° K in a silicon semiconductor, for example. A band gap module uses a voltage difference between a pair of matched forward-biased PN junctions operating at different current densities to generate a current that increases with increasing temperature, commonly called proportional to absolute temperature (PTAT). This current is used to generate a PTAT voltage in a resistor that is added to a CTAT voltage across a semiconductor PN junction, which may be one of the matched pair. The ratio of the PTAT and CTAT voltages may be set by setting resistance values, for example, so that the temperature dependencies of the PTAT and CTAT voltages compensate each other to a first order approximation. Typically, in a semiconductor device, the resulting voltage is about 1.2-1.3 V, close to the theoretical band gap of silicon at 0° K, 1.22 eV. The residual second order approximation of the temperature dependency typically is small within the operating temperature range around the temperature at which the ratio of the PTAT and CTAT voltages is set.

Trimming resistance values for the band gap module is conveniently performed digitally by setting switches or fuses to connect or short circuit trim resistors. It is desirable to be able to trim the resistance values bidirectionally about a central value, which is not the case in some known implementations. In some conventional implementations, it is necessary for the ON resistance of the trim switches to be small to reduce inaccuracy introduced by variability of their ON resistance, for example with variation of supply voltage. Trim switches with small ON resistance in conventional implementations tend to occupy a large area of the IC.

BRIEF DESCRIPTION OF THE DRAWINGS

The present invention is illustrated by way of example and is not limited by embodiments thereof shown in the accompanying figures, in which like references indicate similar elements. Elements in the figures are illustrated for simplicity and clarity and have not necessarily been drawn to scale.

DETAILED DESCRIPTION OF THE INVENTION

Figure 1:
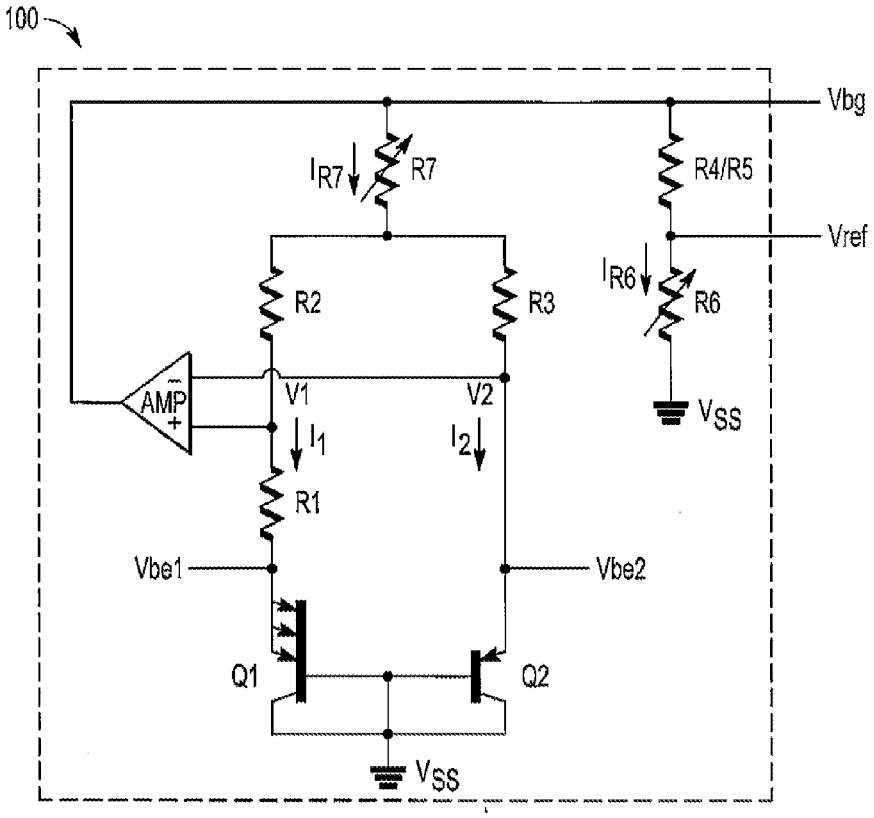
FIG. 1 is a schematic circuit diagram of a conventional band gap reference voltage generator.

FIG. 1 is a schematic circuit diagram of a conventional band gap reference voltage generator 100. The band gap reference voltage generator 100 includes a trim resistor network R7 and a trim resistor network shown as resistors R4/R5 and R6 in addition to forward biased diode-connected bipolar junction transistors (BJT) Q1 and Q2 connected in a band gap voltage generator configuration, where the emitter area of BJT Q1 is M times the emitter area of BJT Q2. The base-emitter voltages Vbe1 and/or Vbe2 are measured at a single predetermined temperature. Based upon the measured base-emitter voltages, the resistor networks R7 and/or R4/R5 are trimmed to provide a desired band gap voltage at that temperature. The output voltage trimming sequence comprises measuring a first voltage Vbe1 across the base-emitter terminals of BJT Q1 at a single temperature, using Vbe1 to determine a resistance value of the first trim resistance network R7 and trimming the first trim resistance network R7 to that resistance value. The trimming step includes measuring a second voltage Vbe2 across the base-emitter terminals of the second BJT Q2 at the same temperature. Subsequent to performing the trimming sequence of the band gap voltage Vbg to reduce the temperature coefficient, voltage compensating trimming to minimize the absolute value of the output voltage may be performed. The compensating trimming step comprises: trimming the second and third trim resistance networks R4/R5 and R6 such that the desired output reference voltage Vref is achieved.

Figure 2:
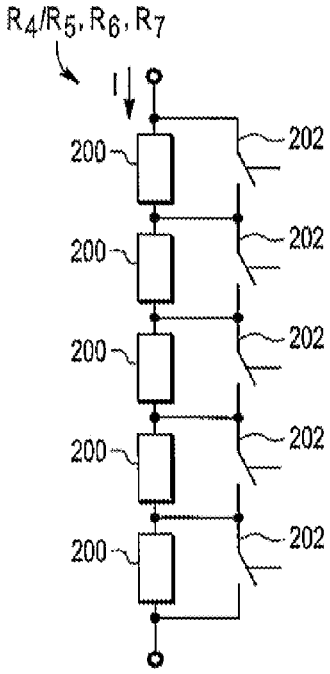
FIG. 2 is a schematic diagram of a configuration of a variable resistor in the band gap reference voltage generator of FIG. 1.
Figure 3:
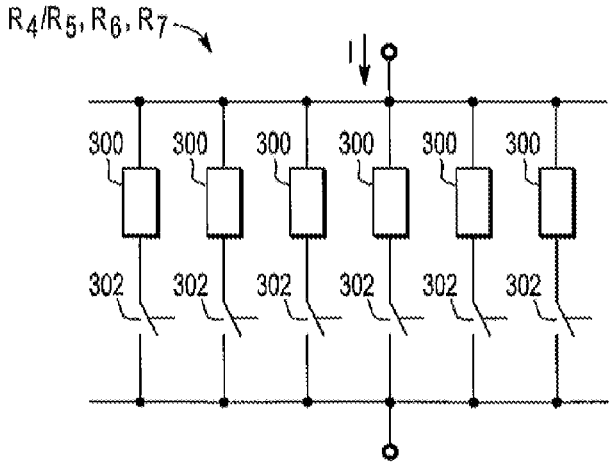
FIG. 3 is a schematic diagram of an alternative configuration of a variable resistor in the band gap reference voltage generator of FIG. 1.

The trim resistor networks R7, R4/R5, and R6 carry currents that generate the voltage required across the resistance network. Examples of conventional resistance network are shown in FIGS. 2 and 3 and include a ladder of resistor elements 200 and a set of switch elements 202, or a parallel connection of a set of resistors 300 each in series with respective switch elements 302. The switch elements 202 or 302 are selectively switched ON or OFF to short circuit or include the corresponding resistance elements 200 in the current path of the network or to include or exclude the corresponding resistance elements 300 in the current path of the network. When the switch elements 202 or 302 are ON, they carry the current through the network and variations of the ON-resistance of the switch elements 202 or 302 will affect the accuracy of the output reference voltage Vref. If the switch elements 202 or 302 are metal-oxide semiconductor field-effect transistors (MOSFETs), for example, the ON-resistance is a function of the power supply voltage and in order for the variation of the output reference voltage Vref to be reduced to an acceptable value, the ON-resistance of the switch elements 202 or 302 must be low, which consumes a large area of the IC. If the switch elements 202 or 302 are fuses, it is possible to obtain a low short-circuit resistance with a smaller IC area per fuse, but a corresponding number of dedicated electrical contact pads are needed in order to blow the fuses selectively during manufacture, which again leads to a large consumption of IC area. Moreover, the use of fuses is less flexible, since the adjustment is unidirectional.

Figure 4:
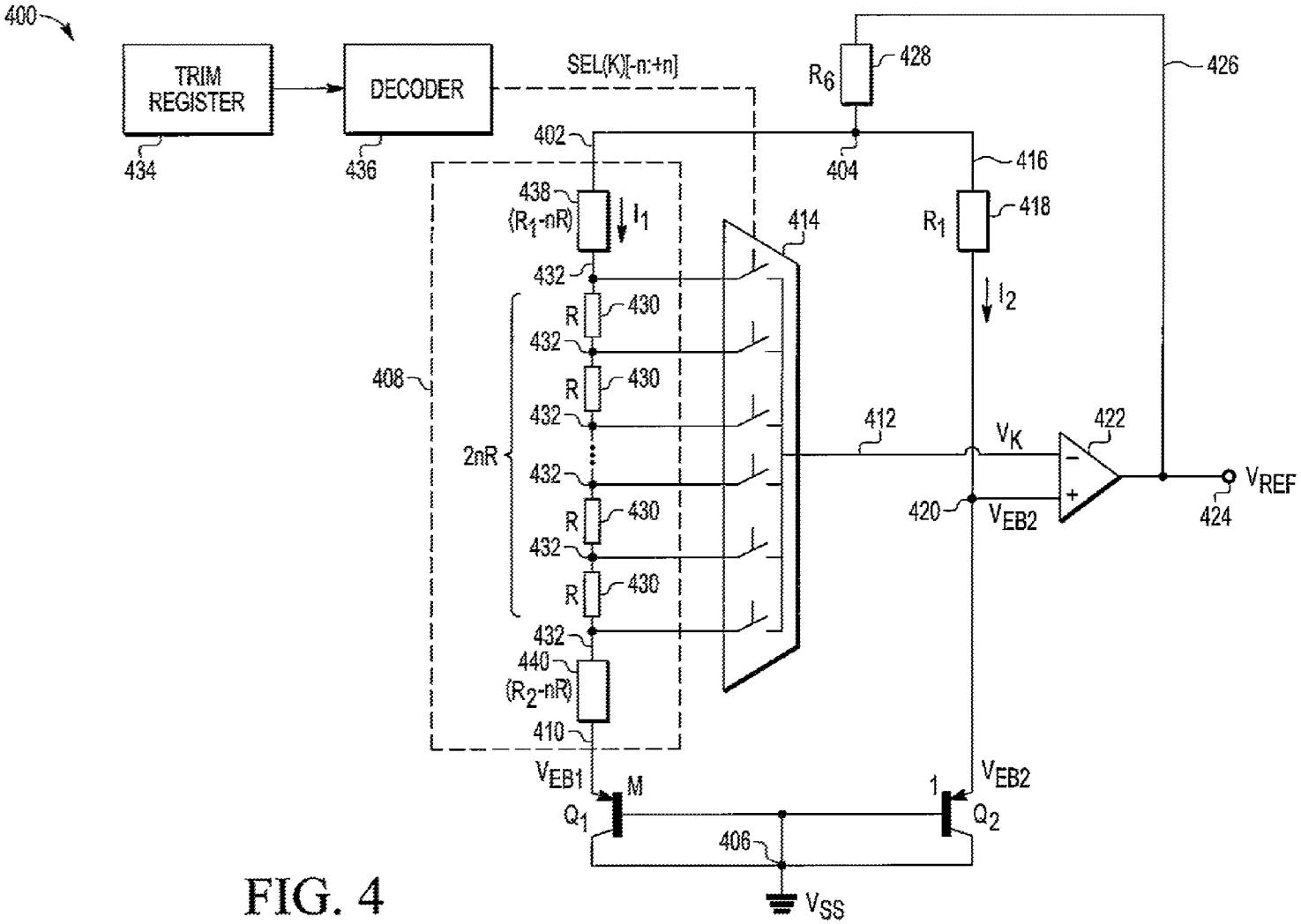
FIG. 4 is a schematic circuit diagram of a band gap reference voltage generator in accordance with an embodiment of the invention, given by way of example.

Referring now to FIG. 4, a band gap reference voltage generator 400 in accordance with an example of an embodiment of the present invention is shown. The band gap reference voltage generator 400 comprises first and second forward-biased PN junction elements $Q_1$ and $Q_2$ of different current densities. A first current conduction path 402 between a first node 404 and a second node 406 includes a plurality of first resistive elements 408 connected in series between the first node 404 and a third node 410, and the first PN junction element $Q_1$, which is connected in series between the third node 410 and the second node 406. The first resistive elements 408 are connected in a voltage divider configuration with a tap 412 connected selectively to the first resistive elements 408 through switch elements 414, which are controllable to select a voltage divider ratio at the tap 412.

A second current conduction path 416 between the first node 404 and the second node 406 includes a second resistive element 418 connected in series between the first node 404 and a fourth node 420, and the second PN junction element $Q_2$ which is connected in series between the fourth node 420 and the second node 406. A voltage error amplifier 422 has a first input connected to the tap 412, a second input connected to the fourth node 420, and an output 424 for providing a thermally compensated output voltage $V_{REF}$. A feedback path 426 applies the output voltage $V_{REF}$ to a series connection of a third resistive element 428 with the first and second nodes 404 and 406.

In this example of the band gap reference voltage generator 400, the PN junction elements $Q_1$ and $Q_2$ comprise bipolar junction transistors (BJTs) having emitter, base and collector regions, the base regions being connected to the respective collector regions, and respective forward biased base-emitter junctions that are connected in series with the first and second current conduction paths 402 and 416. The plurality of first resistive elements 408 includes a plurality of resistive trim elements 430 and a plurality of connector elements 432 connecting the resistive trim elements 430 in series, the switch elements 414 being controllable to connect the tap 412 selectively with a connector element 432 and select a value of the voltage divider ratio at the tap 412, which is settable bidirectionally about a central value. This example of the band gap reference voltage generator 400 includes a controller for controlling the switch elements 414 to select and set the voltage divider ratio at the tap 412. The controller includes a trim register 434 and a decoder 436, which control a multiplexer including the switch elements 414. The first PN forward-biased junction element $Q_1$ has a smaller current density than the second PN forward-biased junction element $Q_2$ the ratio of the densities being M to 1, and the plurality of first resistive elements 408 presents a greater resistance than the second resistive element 418. The first input of the voltage error amplifier 422 is an inverting input and the second input of the voltage error amplifier is a non-inverting input.

In more detail, the plurality of first resistive elements 408 includes a first resistor 438 having a resistance of $R_1$-nR connected in series between the first node 404 and the resistive trim elements 430, a second resistor 440 having a resistance of $R_2$-nR connected in series between the third node 410 and the resistive trim elements 430, and the plurality of resistive trim elements 430 comprises a ladder of 2n trim resistors of value R. The resistance presented in the first current conduction path 402 between the first node 404 and the third node 410 is independent of the voltage divider ratio and is equal to $R_1+R_2$. The resistance presented in the second current conduction path 416 by the second resistive element 418 is chosen to be equal to $R_1$. The position of connection of the tap 412 to the ladder of 2n trim resistors 430 of value R selected by the trim register 434 and the decoder 436 corresponds to a number k of the trim resistors 430, between −n and +n from the mid-point of the ladder of trim resistors 430 and selects the voltage divider ratio of the first resistive elements 408, which is equal to $R_2/(R_1+R_2)$ when k is zero. The values of the resistances, including the resistor 428, and the bias voltages of the voltage error amplifier 422 are chosen so that nominally the output voltage $V_{REF}$ has a suitable value when the number k is equal to zero.

However, the actual characteristics of the voltage generator 400 are subject to variation due to manufacturing process variations, for example. The voltage divider ratio of the resistive elements 408 is adjusted by the trim register 434 and the decoder 436 during testing of the voltage generator 400 during production by measurement of the output voltage $V_{REF}$ compared to a standard reference voltage, at a specific temperature, to compensate for differences from the nominal characteristics of the voltage generator 400. The resistance R of the trim resistors 430 is chosen to be sufficiently small to provide a fine adjustment to the voltage divider ratio, while providing a sufficient range of fine adjustment without unduly increasing the number of trim resistors 430 and corresponding switch elements 414; in this example, it has been possible to limit the number of trim resistors 430 and corresponding switch elements 414 to sixteen. The value of the number k of the trim resistors 430 can be varied between −n and +n about the nominal value of zero, so that bidirectional adjustment is possible about the mid-point of the ladder of trim resistors 430 and, if the adjustment process overshoots, the direction of adjustment can be reversed, unlike with blowing fuses.

The voltage $V_k$ at the tap 412 is applied to the inverting input of the amplifier 422 and the voltage drop $V_{EB2}$ appearing at the node 420 is applied to the non-inverting input of the amplifier 422. For a given current and temperature, the voltage drop $V_{EB1}$ across the BJT $Q_1$, which has a current density M times less than the matched BJT $Q_2$, is less than the voltage drop $V_{EB2}$ across the BJT $Q_2$. The plurality of first resistive elements 408 presents a greater resistance than the second resistive element 418, but the nominal values of the resistances $R_1$, $R_2$, $R_6$ and R, are chosen so that the voltage $V_k$ at the tap 412 is nominally equal to the voltage drop $V_{EB2}$ across the BJT $Q_2$ when the number k of the trim resistors 430 is equal to zero, corresponding to the mid-point of the ladder of 2 n trim resistors 430.

The negative feedback loop 426 makes the sum of the currents $I_1$ and $I_2$ in the resistor 428 and flowing respectively in the first and second current conduction paths 402 and 416 adjust to a level at which the voltage $V_k$ and the voltage drop $V_{EB2}$ at the inputs of the amplifier 422 are substantially equal.

Figure 5:
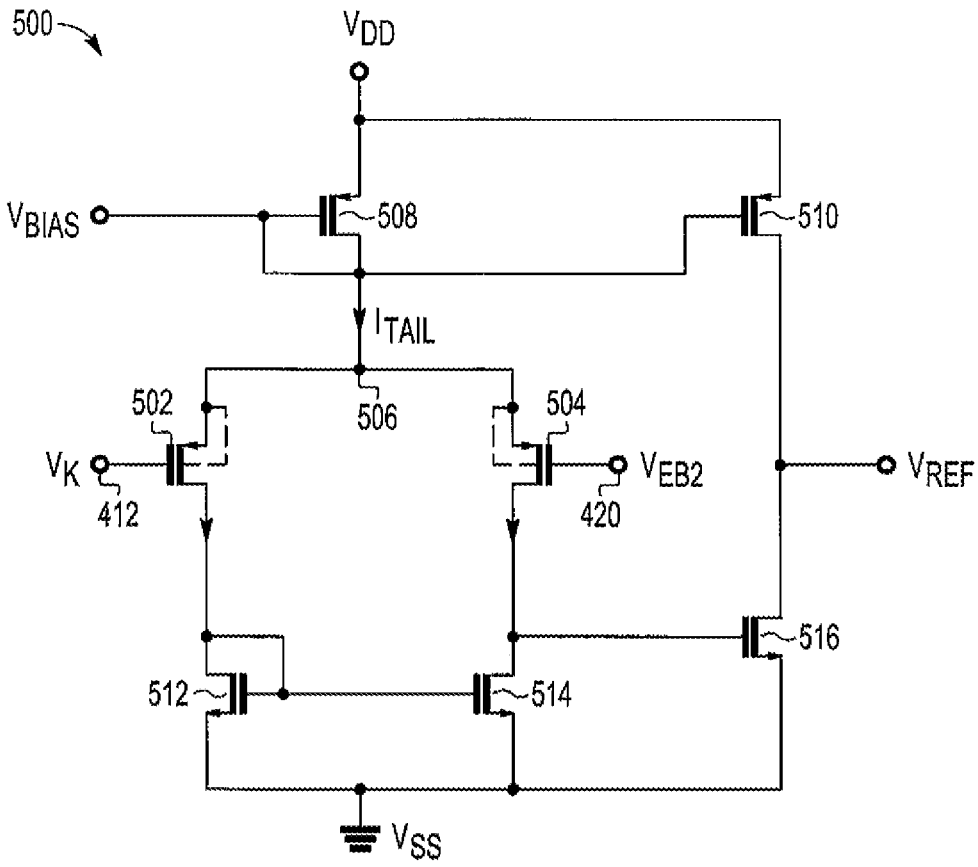
FIG. 5 is a schematic circuit diagram of an example of an error amplifier of the band gap reference voltage generator of FIG. 4.

FIG. 5 illustrates an example 500 of the error amplifier 422 in the band gap reference voltage generator 400. The error amplifier 500 has p-type MOSFETs 502 and 504 connected in long-tailed pair configuration, with their sources connected to a common node 506. A p-type MOSFET 508 has a source connected to a voltage supply $V_{DD}$, a drain connected to the node 506 and a gate connected to a source of bias voltage $V_{BIAS}$ (not shown). A p-type MOSFET 510 has a source connected to the voltage supply $V_{DD}$, a drain connected to the output terminal 424 and a gate connected to the source of bias voltage $V_{BIAS}$. N-type MOSFETs 512 and 514 are connected in current mirror configuration between the drains of the MOSFETs 502 and 504 respectively and a voltage source $V_{SS}$. The gates of the MOSFETs 512 and 514 are connected together and to the drains of the MOSFETs 502 and 512 and their sources are connected to the voltage source $V_{SS}$. The drain of the MOSFET 514 is connected to the gate of an n-type MOSFET 516 whose source is connected to the voltage source $V_{SS}$ and whose drain is connected to the output terminal 424. The current mirror copies the part of the common current $I_{TAIL}$ flowing in the MOSFETs 502 and 512 to the MOSFETs 504 and 514 so that the current signals add to the voltage signal, increasing the gain of the amplifier 500.

The output voltage $V_{REF}$ can be represented as the sum of a constant biasing voltage and a thermally compensated correction $f_{vbg}$. The voltage $V_k$ at the tap 412 is given by:

$$V_k = V_{EB1} + I_1(R_2 + kR)$$

The voltage error amplifier 422 and the feedback loop 426 make the voltage $V_k$ at the tap 412 substantially equal to the voltage drop $V_{EB2}$ appearing at the node 420, so that:

$$V_k = V_{EB1} + I_1(R_2 + kR) = V_{EB2}$$

The current $I_1$ in the first current conduction path 402 is given by:

$$I_1 = \Delta V_{EB}/(R_2 + kR),$$

where $\Delta V_{EB}$ is the difference between the base-emitter voltage drops $V_{EB2}$ and $V_{EB1}$ across the BJTs $Q_2$ and $Q_1$, which is PTAT. The voltage between the nodes 404 and 406 is the same for the first and second current conduction paths 402 and 416, so that:

$$V_{EB2} + I_2 R_1 = V_{EB1} + I_1(R_2 + R_1), \text{ and}$$

$$I_2 = \frac{I_1(R_2 + R_1) - \Delta V_{EB}}{R_1} = I_1(1 - kR/R_1)$$

The Schockley diode equation gives:

$$V_{EB1} \approx V_T \ln(I_1/MI_S), V_{EB2} \approx V_T \ln(I_2/I_S),$$

where $I_S$ is a normalized reverse-biased saturation current, much smaller than $I_1$ or $I_2$, $V_T$ is the thermal voltage given by k'T/q, where k' is the Boltzmann constant, T is the absolute temperature in ° K and q is the charge of an electron, and where M is the ratio of current densities of the BJTs $Q_2$ and $Q_1$.

From the above, $I_1$ is given by:

$$I_1 = \frac{V_T}{(R_2 + kR)}[\ln(1 - kR/R_1) + \ln M]$$

To a first order, if kR is much smaller than $R_1$ and $R_2$:

$$\frac{V_T}{(R_2 + kR)} \approx V_T/R_2(1 - kR/R_2) \text{ and } \ln(1 - kR/R_1) \approx -kR/R_1,$$

and:

$$I_1 = \frac{V_T}{R_2}(\ln M - kR/R_2 \ln M - kR/R_1), \quad k \in [-n: +n]$$

$$I_2 = \frac{V_T}{R_2}(\ln M - k(R/R_1 + R/R_2)\ln M - kR/R_1), \quad k \in [-n: +n]$$

From these equations, the value of the thermally compensated correction $f_{vbg}$ to the output voltage $V_{REF}$ can be derived as:

$$f_{vbg}(T, k) = f_{vbg}(T)|_{k=0} + k * C * V_T, \; k \in [-n, n]$$

$$f_{vbg}(T)|_{k=0} = \left(\frac{R_1}{R_2} + \frac{2R_6}{R_2}\right)V_T \ln M + V_{EB2}(T)\Big|_{k=0}$$

In these equations, M is a constant, C is a parameter that depends on M and on the ratios of two resistances, and the resistance ratio values can be made constant with temperature by matching their production process and design. The temperature coefficient of the output voltage $V_{REF}$ is measured with the number k equal to zero and thermal compensation can be achieved to a first order by adjusting the number k using the trim register 434, decoder 436 and the switch elements 414.

Only one of the switch elements 414 is turned ON at any one time, selecting the voltage divider ratio of the first resistive elements 408. The voltage error amplifier 422 presents a high input impedance. Accordingly, current flow through the ON switch element 414 is small and variation in its ON resistance has only a small effect on the performance of the band gap reference voltage generator 400 and a higher ON resistance can be tolerated readily. In the band gap reference voltage generator 400, the resistive trim elements 430 are all of equal value. In configurations as shown in FIGS. 2 and 3, it is possible to choose resistive trim elements 200 or 300 of different sizes, which are combined by turning ON simultaneously different combinations of the switch elements 202 and 302 so that for a given number of trim steps (sixteen in the case of the band gap reference voltage generator 400) a smaller number of resistive trim elements 200 or 300 and switch elements 202 and 302 can be used (four of each to obtain sixteen trim steps). However, the area occupied by a switch element 202 or 302 itself, or the area occupied by pads to enable a fuse to be blown if fuses are substituted for the switch elements 202 and 302, is much larger than the area of a switch element 414 of the band gap reference voltage generator 400. In examples of equal precision, it has been found that the area occupied by switch elements 202 or 302, or the area occupied by pads for fuses, in the configurations shown in FIGS. 2 and 3 were between approximately twenty-five and forty times greater than in the band gap reference voltage generator 400, in spite of having four times fewer switch elements 202 or 302 (or pads for fuses).

In the foregoing specification, the invention has been described with reference to specific examples of embodiments of the invention. It will, however, be evident that various modifications and changes may be made therein without departing from the broader spirit and scope of the invention as set forth in the appended claims. For example, the semiconductor substrate described herein can be any semiconductor material or combinations of materials, such as gallium arsenide, silicon germanium, silicon-on-insulator (SOI), silicon, monocrystalline silicon, the like, and combinations of the above. The PN junctions may be formed by diodes or diode-connected BJTs or MOSFETs or other transistors.

The connections as discussed herein may be any type of connection suitable to transfer signals from or to the respective nodes, units or devices, for example via intermediate devices. Accordingly, unless implied or stated otherwise, the connections may be direct connections or indirect connections. The connections may be illustrated or described in reference to being a single connection, a plurality of connections, unidirectional connections, or bidirectional connections. However, different embodiments may vary the implementation of the connections. For example, separate unidirectional connections may be used rather than bidirectional connections and vice versa. Also, a plurality of connections may be replaced with a single connection that transfers multiple signals serially or in a time multiplexed manner. Likewise, single connections carrying multiple signals may be separated out into various different connections carrying subsets of these signals. Therefore, many options exist for transferring signals.

Although specific conductivity types or polarity of potentials have been described in the examples, it will be appreciated that conductivity types and polarities of potentials may be reversed.

Also for example, in one embodiment, the illustrated examples may be implemented as circuitry located on a single integrated circuit or within a same device. Alternatively, the examples may be implemented as any number of separate integrated circuits or separate devices interconnected with each other in a suitable manner.

In the claims, the words 'comprising' and 'having' do not exclude the presence of other elements or steps then those listed in a claim. The terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The fact that certain measures are recited in mutually different claims does not indicate that a combination of these measures cannot be used to advantage.

The invention claimed is:

1. A band gap reference voltage generator, comprising:

first and second forward-biased PN junction elements of different current densities;

a first current conduction path between a first node and a second node, including a plurality of first resistive elements that are connected in series between said first node and a third node, and said first PN junction element that is connected in series between said third node and said second node, wherein said first resistive elements are connected in a voltage divider configuration, wherein said plurality of first resistive elements includes a plurality of resistive trim elements having a ladder of 2n trim resistors of value R, a plurality of connector elements connecting said resistive trim elements in series, a first resistor having a resistance of $R_1$-nR connected in series between the first node and the plurality of resistive trim elements, and a second resistor having a resistance of $R_2$-nR connected in series between the third node and the plurality of resistive trim elements, wherein the n is a natural number;

a tap connected selectively to said first resistive elements through switch elements, wherein the switch elements are controllable to select a voltage divider ratio at said tap;

a second current conduction path between said first and second nodes, including a second resistive element connected in series between said first node and a fourth node, and said second PN junction element that is connected in series between said fourth node and said second node;

a voltage error amplifier having a first input connected to said tap, a second input connected to said fourth node, and an output for providing a thermally compensated output voltage; and a feedback path for applying said output voltage to a series connection of a third resistive element with said first and second nodes.

2. The band gap reference voltage generator of claim 1, wherein said PN junction elements comprise bipolar junction transistors (BJTs) having emitter, base and collector regions, said base regions being connected to said collector regions, and respective forward biased base-emitter junctions that are connected in series with said first and second current conduction paths.

3. The band gap reference voltage generator of claim 1, wherein said switch elements are controllable to connect said tap selectively with a respective connector element and select a value of said voltage divider ratio at said tap that is settable bi-directionally about a central value.

4. The band gap reference voltage generator of claim 1, further comprising a controller for controlling said switch elements to select and set said voltage divider ratio at said tap.

5. The band gap reference voltage generator of claim 4, wherein said controller comprises a trim register and a decoder connected to the trim register.

6. The band gap reference voltage generator of claim 1, wherein said first PN forward-biased junction element has a smaller current density than said second PN forward-biased junction element, and said plurality of first resistive elements presents a greater resistance than said second resistive element.

7. The band gap reference voltage generator of claim 1, wherein said first input of said voltage error amplifier is an inverting input and said second input of said voltage error amplifier is a non-inverting input.

8. A method of making a band gap reference voltage generator having first and second forward-biased PN junction elements of different current densities, a first current conduction path between a first node and a second node, including a plurality of first resistive elements that are connected in series between said first node and a third node, and said first PN junction element that is connected in series between said third node and said second node, a second current conduction path between said first node and said second node, including a second resistive element connected in series between said first node and a fourth node, and said second PN junction element connected in series between said fourth node and said second node, the method comprising:

connecting said first resistive elements in a voltage divider configuration with a tap connected selectively to said first resistive elements through switch elements;

controlling said switch elements to select a voltage divider ratio at said tap;

providing a voltage error amplifier having a first input connected to said tap, a second input connected to said fourth node, and an output for providing a thermally compensated output voltage; and providing a feedback path for applying said output voltage to a series connection of a third resistive element with said first and second nodes, wherein said plurality of first resistive elements includes a plurality of resistive trim elements having a ladder of 2n trim resistors of value R, a plurality of connector elements connecting said resistive trim elements in series, a first resistor having a resistance of $R_1$-nR connected in series between the first node and the plurality of resistive trim elements, and a second resistor having a resistance of $R_2$-nR connected in series between the third node and the plurality of resistive trim elements, wherein the n is a natural number.

9. The method of claim 8, wherein said PN junction elements comprise bipolar junction transistors (BJTs) having emitter, base and collector regions, said base regions being connected to said collector regions, and respective base-emitter junctions that are forward biased and connected in series with said first and second current conduction paths.

10. The method of claim 8, wherein connecting said first resistive elements in a voltage divider configuration includes connecting said resistive trim elements in series with a plurality of connector elements, and connecting said switch elements between respective ones of said connector elements and said tap, and controlling said switch elements includes connecting said tap selectively through one of said switch element with the respective connector element to select a value of said voltage divider ratio at said tap which is settable bidirectionally about a central value.

* * * * *